US006224522B1

(12) United States Patent
Ervin

(10) Patent No.: US 6,224,522 B1
(45) Date of Patent: May 1, 2001

(54) SWING EXERCISER

(76) Inventor: Derrick Ervin, 3494 Cambridge, Detroit, MI (US) 48221-1857

( * ) Notice: Subject to any disclaimer, the term of this patent is extended or adjusted under 35 U.S.C. 154(b) by 0 days.

(21) Appl. No.: 09/506,482

(22) Filed: Feb. 17, 2000

Related U.S. Application Data

(60) Provisional application No. 60/120,542, filed on Feb. 17, 1999.

(51) Int. Cl.[7] ..... A63B 69/36

(52) U.S. Cl. ..... 482/121; 482/130; 482/92

(58) Field of Search ..... 482/121, 123, 482/129, 92; 473/229, 258, 425, 415, 604, 422–424

(56) References Cited

U.S. PATENT DOCUMENTS

| | | | | |
|---|---|---|---|---|
| 2,848,234 | * | 8/1958 | Brandon | 482/121 |
| 3,083,016 | * | 3/1963 | Sumeyi | 482/121 |
| 4,328,964 | * | 5/1982 | Walls | 482/121 |
| 4,593,909 | | 6/1986 | Anselmo et al. . | |
| 5,040,788 | * | 8/1991 | Randall | 482/121 |
| 5,149,909 | | 9/1992 | Hagen et al. . | |
| 5,174,575 | | 12/1992 | Leith et al. . | |
| 5,186,698 | * | 2/1993 | Masan et al. | 482/29 |
| 5,250,016 | * | 10/1993 | Higgins | 482/121 |
| 5,295,690 | | 3/1994 | Johnson . | |
| 5,301,948 | | 4/1994 | Hundley . | |
| 5,303,927 | | 4/1994 | Perry et al. . | |
| 5,308,074 | | 5/1994 | Dorotinsky et al. . | |
| 5,628,695 | * | 5/1997 | Worthington et al. | 473/229 |
| 5,637,061 | * | 6/1997 | Price, II | 482/92 |
| 5,916,037 | | 6/1999 | Hill . | |

* cited by examiner

*Primary Examiner*—Jerome W. Donnelly
(74) *Attorney, Agent, or Firm*—Gifford, Krass, Groh, Sprinkle, Anderson & Citkowski, PC

(57) ABSTRACT

A simple and economical yet effective training and exercising device is disclosed for sports such as golf wherein an implement such as a golf club is moved along a swing path. An elongated handle has a proximal end with a hand grip and a distal end with a weighted body. A foot plate, sized to received a foot of the user, includes one or more connection features, preferably inverted-U-shaped hooks rigidly secured to the foot plate. A removable, stretchable tether is provided having a first end tied at a point between the proximal and distal ends of the handle and a second end tied to a connection point on the foot plate. The connection point on the handle is preferably a hook which doubles as a wrist indicator. The length of the tether is adjustable so as to resist upward movement of the handle when swung by the user to promote training and exercise with respect to the sport. The foot plate has inside and outside edges, and in the preferred embodiment, each edge includes one or more connection points to practice a back swing and a forward swing. Two tethers may also be used, each having a first end tied at the point between the proximal and distal ends of the handle, and with the second end of one tether being tied to an outer connection point of the foot plate, and the second end of the other tether being tied to an inner connection point of the foot plate. An optional rocker plate defines an area large enough to receive the foot plate and the user's other foot. The rocker plate preferably further includes one or more movable, rotatable plates to assist in positioning the user's feet to achieve a proper stance for the desired sport. Each movable, rotatable plate may preferably be locked into place along a rail feature. The invention swing exerciser may be used for many other sports besides golf such as tennis, hockey, and so forth.

13 Claims, 4 Drawing Sheets

SWING EXERCISER

REFERENCE TO RELATED APPLICATION

This application claims priority from U.S. provisional application Ser. No. 60/120,542, filed Feb. 17, 1999, the contents of which are incorporated herein by reference.

FIELD OF THE INVENTION

The present invention relates to a portable exercise machine. More specifically, the invention relates to an exerciser for teaching balance, building muscle and developing muscle memory for all sports involving equipment used to create a swing path, including golf, baseball, tennis, hockey, squash and racquetball.

BACKGROUND OF THE INVENTION

There are literally hundreds of inventions relating to golf, some of which are over a hundred years old. Various implements have been devised for swing training, typically employing harnesses with loops and tethers to physically constrain one or more body movements. Many of these assemblies are complicated and difficult to set up and/or use.

Disclosed in U.S. Pat. No. 4,593,909 is a knock-down golf-swing training for use indoors and outdoors. A main frame is formed of tubular components including a large area base assembly, and a vertically adjustable upright post mounted medially of the rear edge of the base assembly, outriggers for the base assembly, a safety harness, and a plurality of belt loops adapted for assembly loosely about either or both ends of the player's torso while practicing golf swings.

The golf-swing training device of U.S. Pat. No. 5,149,909 employs an elastic loop worn around the neck, chest and hips, with most of the loop resting over the chest, abdomen and shoulders. The player swings against an upward pull exerted by tension in the elastic loop to produce improved control of the golfer's arms. The device emphasizes left hand and left arm movements for right-handed players, and does not appear to meet a wider variety of goals in swing and exercise conditioning.

U.S. Pat. No. 5,174,575, discloses a harness which restricts a golfer's arm and hand movements while making practice swings. A tether is attached to a point on the shaft of the golf club just above the club head, and extends to a point on the golfer's forearm where it is adjustably fastened. Again, the apparatus appears to be limited in terms of range of motion and other factors.

U.S. Pat. No. 5,295,690 uses two interconnected elastic arm cuffs that fit over a golfer's arms to bias them towards one another other during a golf swing. An elastic hip strap is connected to the cuff holding the trailing swing arm. The device is somewhat complex, and the physical constraints imposed by the apparatus may not improve muscle memory training. An even more complex golf-swing training apparatus is disclosed in U.S. Pat. No. 5,301,948. The device employs a system of articulated arms force a golfer to maintain one swing plane. In addition to swing element, a swing-plane adjuster element, and an upright post-and-base element to support the movable elements from the floor, the device features an adjustable counterbalance to vary loading.

The golf training device of U.S. Pat. No. 5,303,927 includes an elastic cord having one end attached to a belt worn by the user and the opposite end is attached to a foot-receiving stirrup. The configuration is intended to create a rotational torque at the hips to assists the player in maintaining a proper body stance associated with a well-executed swing. In the golf training aid of U.S. Pat. No. 5,308,074 a flexible cord extends from a waist belt to a stake in the ground. The cord is designed to stretch during the user's backswing and retract during follow-through.

The golf-swing training device of U.S. Pat. No. 5,916,037 includes a base for receiving a golfer's front foot, at least one pivot arm having a first end pivotally mounted to the base, and biasing means for biasing the pivot arm to a first position with respect to vertical. An engagement member disposed on the opposite end of the pivot arm is used for engaging the golfer's hip area when positioned to address a golf ball. Engagement of the member displaces the pivot arm to a second position with respect to vertical so as to create a constant pressure force against the golfer's hip area. This supposedly causes the golfer to remember the proper pace and body position for performing a golf swing.

Despite these and other training aids, none are entirely adequate in terms of simplicity, exercise training, and applicability to other sports. Existing devices are either so complex that they will not be used often enough to provide rapid benefit or, if the device is simple, is limited in terms of muscular or memory development for a particular sport or swing pattern.

SUMMARY OF THE INVENTION

The subject invention resides in a simple and economical yet effective training and exercising device for sports such as golf, wherein an implement is moved along a swing path. A device according to the invention features an elongated handle having a proximal end with a hand grip and a distal end with a weighted body. In the preferred embodiment, the weighted body resembles a piece of sports equipment such as a golf club, golf ball, hockey stick, or racquet, and these pieces are preferably attachable to the distal end of the handle through a quick-disconnect connector.

At least one foot plate sized to receive the foot of a user, includes one or more connection features, preferably rigidly secured, inverted-U-shaped hooks. A stretchable tether is provided having a first end tied at a point between the proximal and distal ends of the handle and a second end tied to a connection point on the foot plate. The connection point on the handle is preferably an inverted U-shaped hook which doubles as a wrist indicator. A guard proximate the grip may optionally be provided to prevent the tether from contacting the user. The connector on the handle is preferably removably attachable so that it may be attached to a standard piece of sports equipment.

The length of the tether is adjustable so as to resist upward movement of the handle when swung by the user to promote training and exercise with respect to a given sport. The foot plate has inside and outside edges and, in the preferred embodiment, each edge includes one or more connection points to practice a back swing and a forward swing.

Multiple tethers may also be used, each having a first end secured at the point between the proximal and distal ends of the handle. For example, two tethers may be used, with the second end of one being secured to an outer connection point of the foot plate, and the second end of the other tether being secured to an inner connection point of the foot plate.

The preferred embodiment also further comprises a rocker plate defining an area large enough to receive at least one foot plate and the user's other foot, whether or not a second foot plate is used. The rocker plate optionally further includes one or more movable, rotatable foot positioning plates to assist in stabilizing the user's feet to achieve a proper stance. Each movable, rotatable plate may preferably be locked into place along a rail feature.

The invention swing exerciser may be used for many other sports besides golf such as tennis, hockey, and so forth. In each case, a user can practice both the forehand and backhand swings with the tensioned tether and foot plate placed under the corresponding foot. Like the practice golf swing, the exerciser promotes proper foot planting during the practice forehand or backhand while increasing muscle strength and memory.

DETAILED DESCRIPTION OF THE INVENTION

With reference to FIGS. 1 through 6 in particular, a swing exerciser 10 according to the invention includes a grip 12 appropriate for the sport sought to be improved upon. In a preferred embodiment, the grip 12 is a standard golf training grip to ensure proper placement of the hands 14 during the exercise and to promote proper muscle memory.

Figure 1:
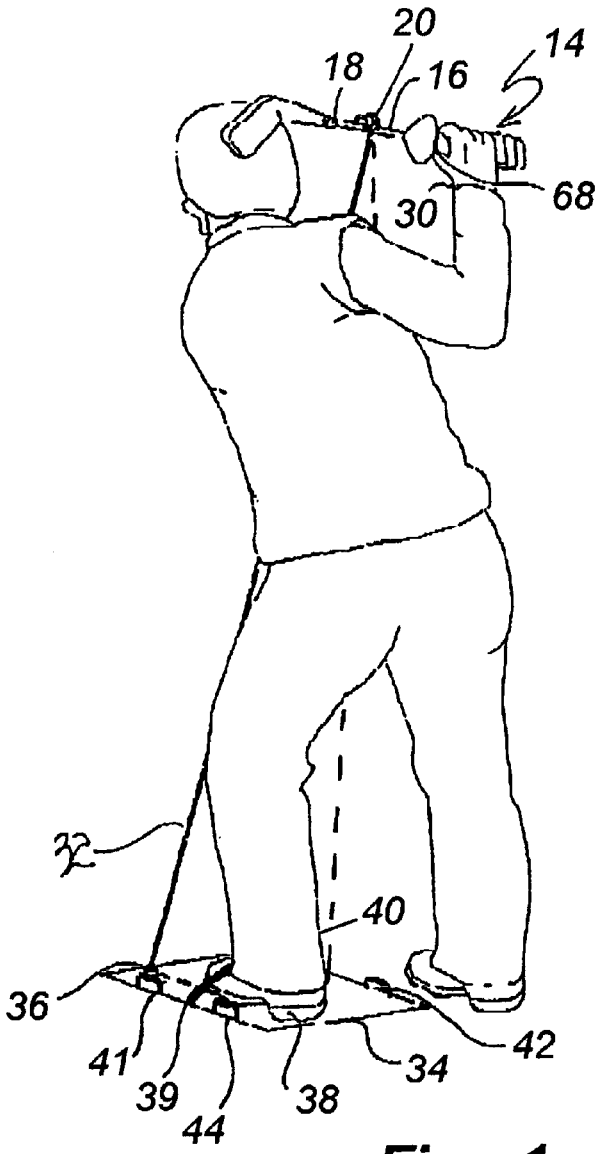
FIG. 1 is a drawing of an individual using a swing exerciser according to the invention to practice a golf swing.
Figure 2:
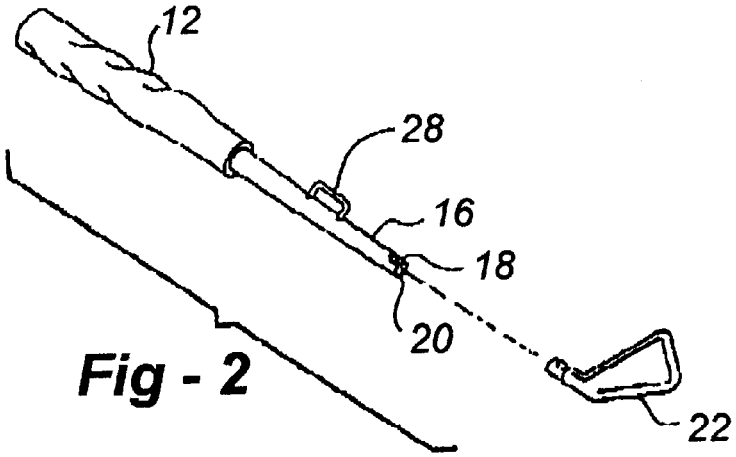
FIG. 2 is a drawing of a handle according to the invention having approximal end of the hand grip, and a weighted body removably attachable to the distal end.
Figure 3:
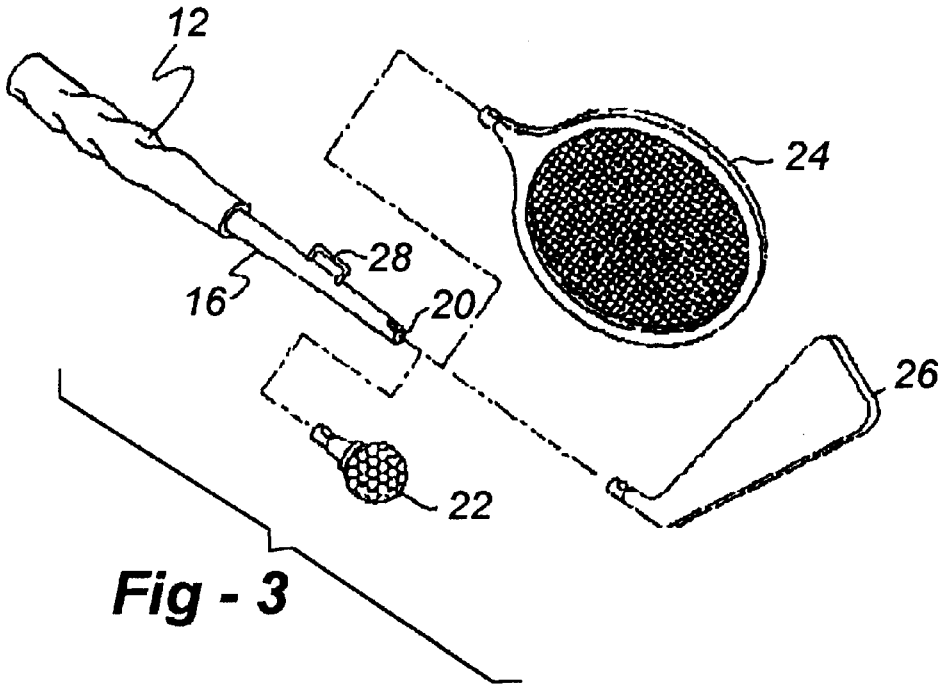
FIG. 3 is an oblique drawing which illustrates how different bodies resembling pieces of sports equipment may be removably attached to the distal end of the handle shown in FIG. 2.

Extending from one end of the grip 12 away from the user is a shaft 16 preferably provided with a quick disconnect 18 at the distal end 20. The quick disconnect 18 allows for easy attachment and removal of a golf ball or miniature golf club 22, racquet 24 or hockey stick 26, as shown in FIG. 3. These attachments may be reduced in size from standard equipment to provide a more compact and travel friendly product.

Figure 4:
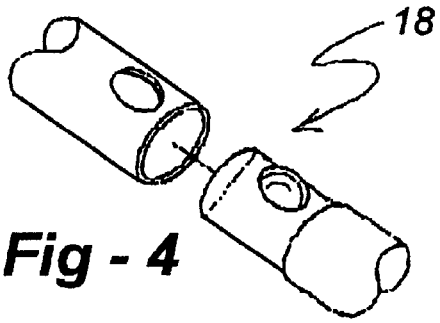
FIG. 4 is an exploded view of a quick-disconnector applicable to the invention.
Figure 5:
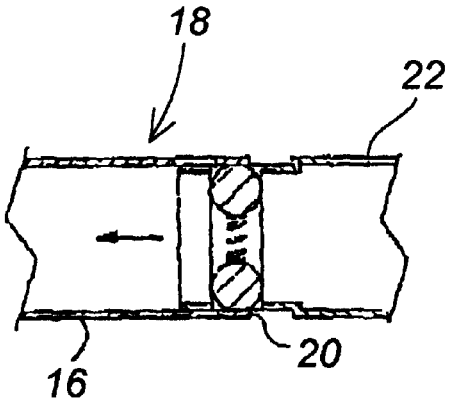
FIG. 5 is a side-view cross section of the quick-disconnector showing the two components being merged together for engagement.
Figure 6:
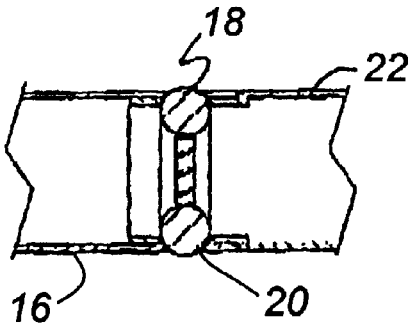
FIG. 6 is a drawing which continues the process of FIG. 5, enabling the two components of the quick-disconnect connector to engage one another and lock into place.

Details of the preferred quick-disconnect mechanism are provided in FIGS. 4 through 6. It would be appreciated that the shaft or handle to which the grip and quick-disconnector attached may be made of various materials, hollow or solid, including metal, plastic, fiber-reinforced composites, and so forth. In addition, although a spring-loaded ball-bearing type of quick-disconnect mechanism is shown, other types of fasteners may be used, including bayonet and threaded types. In addition, extension members may be added, preferably with quick-disconnectors as well, to extend the length of the shaft or handle between the grip and body of the distal end.

Between the quick-disconnect 18 and the grip 12, a wrist indicator 28 is attached along the shaft 16. As indicated by the name, the wrist indicator 28 allows the user to check for proper location of the wrist 30 along the swing path during the exercise as set forth more fully below. The wrist indicator 28 also serves to secure an adjustable tether 32 to the shaft 16. The wrist indicator may be fixed or, optionally may rotate and/or move along the shaft then locked into place. The swing exerciser 10 according to the invention may also be provided with a guard 68 between the grip 12 and the shaft 16 to prevent the tether 32 from contacting the user's hands 14 or other body parts. The guard 68 may be necessary where the user is taller or shorter than the average height range for which the swing exerciser is generally designed.

The tether 32 is secured to a foot plate 34 at the opposite end 36. The tether 32 may be adjusted about the wrist indicator 28 and/or foot plate 34 to increase or decrease tension during exercise as desired. In operation, a user places the foot plate 34 under his foot 38 and adjusts the location of the tether 32 to one of the four U-shaped hooks 40, 41, 42, 44, and tensioning the tether 32 as desired. The tether 32 may also be placed under the foot 38 and atop the foot plate 34, as shown with the broken lines in FIG. 1, to retain more control and feel during the swing.

A preferred tether material is surgical tubing, with different sizes being used for different tensions, and with quick-connect hooks being used where they attach to the handle. It will be apparent to one of skill in the art, however, that since the purpose of the tether is to resist upward motion of the user for forward and back swing movements, other devices may be substituted for this tensioning apparatus, including hydraulic, spring, pneumatic, nautilus type, electro-mechanical tension devices, and free weights connected by pulleys. For example, in addition, although the hooks are shown as rigidly attached to the footplate and shaft 16, either attachment point may rotating or swivel devices to provide reduced wear on the tether. The footplate may also be constructed of various materials, including wood, molded plastic, or metal, and may be of different sizes and shapes, including foot-shaped, though in the preferred embodiment, the footplates measure 12"×6"×½" thick.

With the foot plate 34 under the left foot and the tether 32 connected to either inside hook 40, 42, (and/or outside hooks 41, 44 and/or inside hooks 40, 42) the user can practice a proper back swing including the take away, wrist cock and back swing to impact zone. During each portion of these exercises, the user can constantly monitor the location of his wrists 30 by the wrist indicator 28. With the foot plate 34 under the right foot and the tether 32 connected to either outside hook 41, 44, the user can practice impact zone to follow through, a proper wrist cock at follow through and a complete finish to the swing. As above, the user can monitor the location of his wrists 30 by the wrist indicator 28.

An advantage of the swing exerciser is the tension in the tether in conjunction with the wrist monitor and grip increases muscle strength while simultaneously promoting proper muscle memory resulting in a proper swing path. Tether tension may be increased to increase muscle strength as the user progresses with the exercises.

In addition to securing and tensing the tether, the foot plates help to promote proper spine alignment and proper balance throughout the swing, while, at the same time, preventing the user from lifting his or her feet improperly during the course of the swing exercises. If the user lifts the foot from the foot plate, tension will be released from the tether and result in improper balance during the practice swing. This will immediately become evident to the user and allow the user to adjust his practice swing accordingly.

Two or more tethers may be used simultaneously to increase tension and/or to allow the user to practice a full swing. Both tethers are attached to the wrist indicator 28 at one end, with the other ends being attached to the foot plate(s) at difference points in accordance with a desired goal. In one exercise, for example, a first tether will extend from the wrist indicator 28 under the user's right foot and attache to either outside hook 41, 44. A second tether will extend from the wrist indicator 28 under the user's left foot and attache to either inside hook, 40, 42. Another advantage of using two tethers is the increase in muscle strength and memory during the exercise regime.

Figure 7:
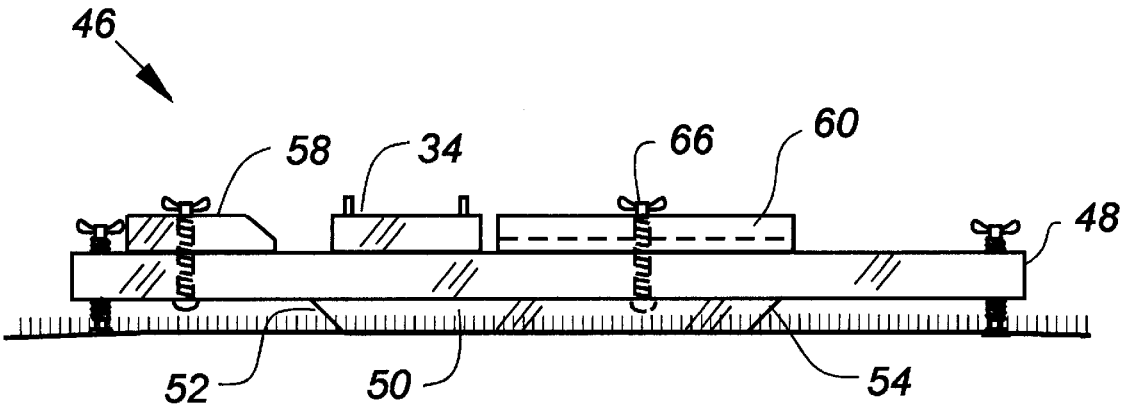
FIG. 7 is a side-view drawing of a rocker plate according to the invention, being sized to receive a footplate and the user's other foot for posture and alignment purposes.
Figure 8:
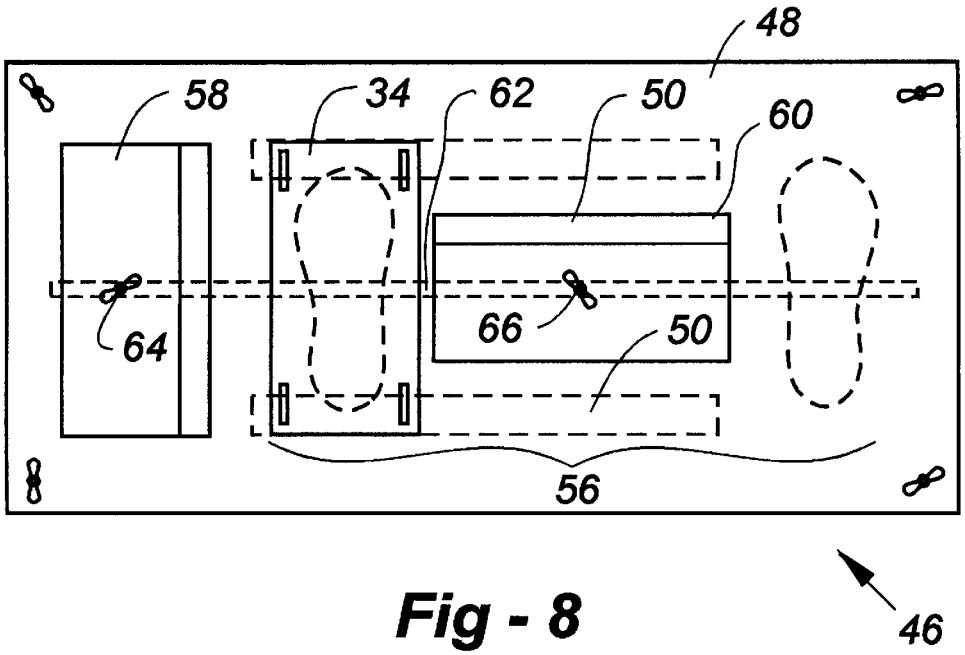
FIG. 8 is a top-down view of the rocker plate of FIG. 7, showing one placement of a user's feet relative to other positioning plates movable and rotatable with respect to a rail and individual locking devices.

Reference is now made to FIGS. 7 and 8, which show the use of a single foot plate 34. In this embodiment, a rocker base plate 46 is provided to ensure proper balance during the practice swing. A level plate 48 is secured atop lower ribs 50, with ends 52, 54 being truncated to create a rocker plate. The base plate 48 and ribs 50 are preferably equipped with means for adjusting the overall length of the plate 48 to adequately provide for the span 56 of the user's stance during swing practice.

Two additional foot-positioning plates 58, 60 are provided atop the base plate 48, and are adjustable laterally and rotationally along a slot 62 extending the length of base plate 48. Plates 58, 60 may be secured in position by a locking mechanisms 64, 66 to secure the plate 58, 60 in a desired position within the slot 62 on the base plate 48. The locking mechanisms 64, 66 are preferably simple manual fasteners such as thumb-screws which engage with the slot 62 to tighten and hold the plates 58, 60 position. The various plates, including the rocker based plate, level plate and additional plates used for positioning guides may also be constructed of any appropriate material, including metal, plastic, and so forth.

By way of example, and as shown in FIG. 8, to use the rocker base plate 46, the user may place plate 58 parallel to the far end 52 of the slot 62 and secure the plate in position by locking mechanism 64. Second plate 60 is then preferably turned 90 degrees from plate 58 along slot 62 a distance equal to the user's span 56. Placing the foot plate 34 between plates 58, 60, the user may step on the rocker base plate 46 with the left foot on top of foot plate 34 against plate 58. The right foot is placed at the opposite end against plate 60, thereby imitating a comfortable swing stance. Now when the user practices a swing path, the rocking motion of the base plate 46 will indicate improper balance. The user may adjust plate 58, 60 to any angle to accommodate an open or closed stance as desired.

Figure 9:
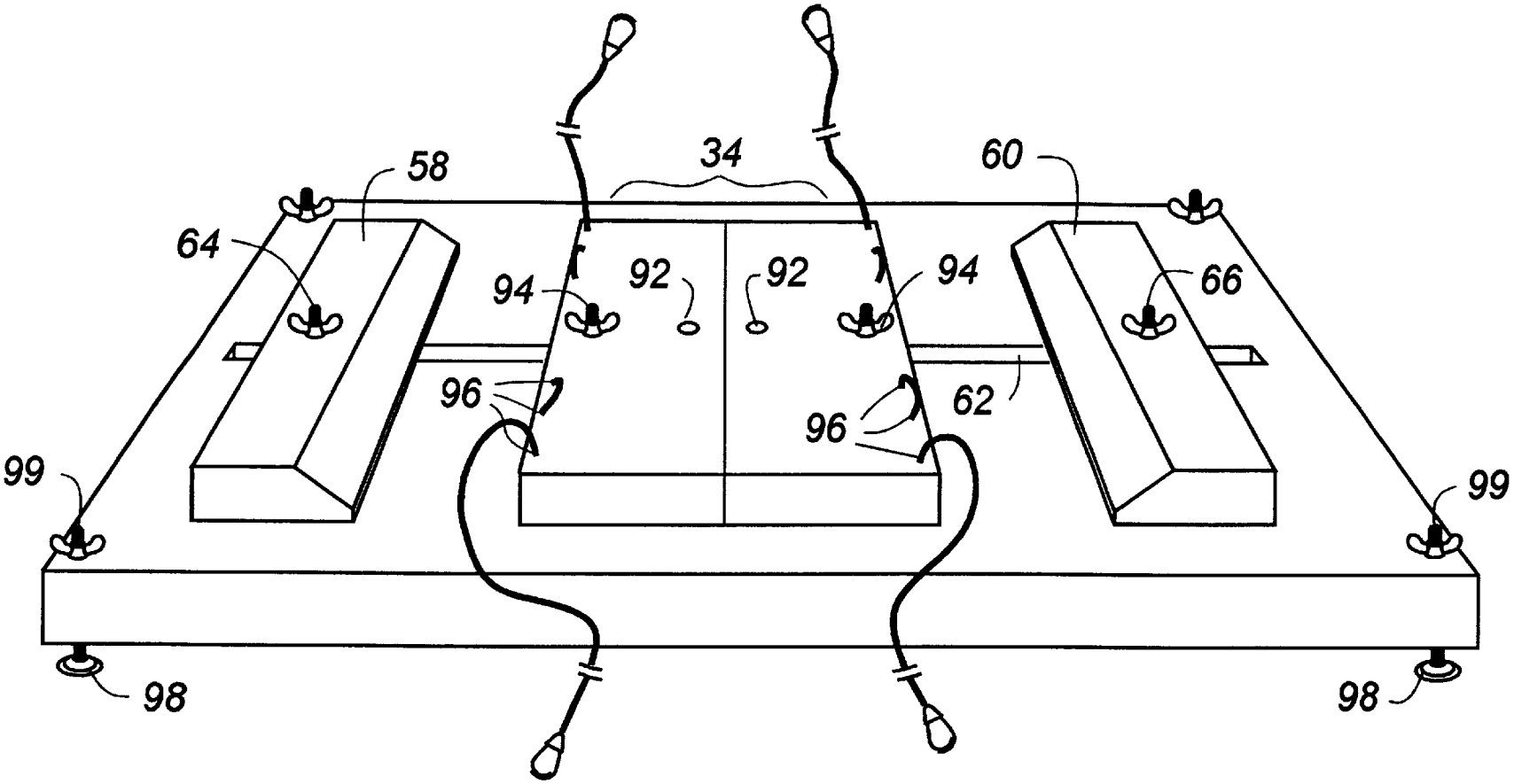
FIG. 9 is a perspective view drawing of a rocker plate with foot plates and positioning guides according to the invention.

FIG. 9 is a drawing which shows a preferred embodiment of the invention using dual foot plates and surgical tubing tethers, as seen from an oblique perspective. It will be noted that the foot-positioning plates 58–60 are preferably beveled at an angle of 45 degrees, though other angles would be acceptable in causing the user to feel the resistance in the left and right side for a better stance and/or posture. Each of the footplates 34 may also include additional holes 92 to change the location of the manual operated fasteners 94 or to individually use over-foot straps, as show in FIG. 1 with numerical reference 39. Optional feet 98 may also be provided, along with adjuster 99 to defeat the operation of the rocker plate, if so desired. The feet 98 may be adjusted up and down for an uphill lie or downhill lie or to simulate other types of terrain.

As stated above, the swing exerciser may be used for many other sports such as tennis or the like. A miniature tennis racquet may be attached to the shaft by the quick release mechanism. The user can then practice both the forehand and backhand swings with the tensioned tether and foot plate placed under the corresponding foot. Like the practice golf swing, the exerciser promotes proper foot planting during the practice forehand or backhand while increasing muscle strength and memory. In addition to the various devices shown, as an option, electro-mechanical or electronic devices such as timers and metronomes may be added to the apparatus to assist in synchronizing the users movements.

I claim:

1. A training and exercising device for sports such as golf, wherein an implement is moved along a swing path, the device comprising:

an elongated handle having a proximal end with a hand grip and a distal end with a weighted body;

a foot plate sized to receive a foot of the user, the foot including one or more connection features; and a removable, stretchable tether having a first end tied at a point between the proximal and distal ends of the handle and a second end tied to a connection point on the foot plate, the length of the tether being adjustable so as to resist upward movement of the handle when swung by the user to promote training and exercise with respect to a desired sport;

a rocker plate defining an area large enough receive the foot plate and the user's foot, wherein the rocker plate further includes at least one movable, rotatable plate to assist in positioning the users feet to achieve a proper stance for the desired sport.

2. The device of claim 1, wherein the weighted body resembles a piece of sports equipment.

3. The device of claim 2, wherein the piece of sports equipment is a golf club, golf ball, hockey stick, or racquet.

4. The device of claim 1, wherein the weighted body attached to the distal end of the handle through a quick-disconnect connector.

5. The device of claim 1, wherein the foot plate has inside and outside edges, each with a one or more connection point to practice a back swing and forward swing, respectively.

6. The device of claim 5, further including tow or more tethers, each having a first end tied at the point between the proximal and distal ends of the handle, and with the second end of one tether being tied to an outer connection point of the foot plate, and the second end of the other tether being tied to an inner connection point of the foot plate.

7. The device of claim 5, wherein the foot plate is provided with separate right and left component parts.

8. The device of claim 1, wherein the connection points are inverted-U-shaped hooks rigidly secured to the foot plate.

9. The device of claim 1, further comprising a guard proximate the grip to prevent the tether form contacting the user.

10. The device of claim 1, wherein each movable, rotatable plate may be locked into place along a rail feature.

11. A golf-swing training and exercising device, comprising:

an elongated shaft having a proximal end with a golf-club-style hand grip, a distal end with a removeably detachable golf-club head, and a wrist indicator;

a foot plate sized to receive a foot of the user, the foot plate including inside and outside edges, each with a one or more connection devices;

a removable, stretchable tether having a first end tied at the wrist indicator and a second end tied to one of the connectionpoints of the foot plate, a rocker plate defining an area large enough to receive the foot plate and the user's foot, wherein the rocker plate further includes at least one movable, rotatable plate to assist in positioning the user feet to achieve a proper stance for the desired sport.

12. The device of claim 11, further including two or more tethers, each having a first end tied at the wrist indicator, and with the second end of one tether being tied to an outer connection point of the foot plate, and the second end of the other tether being tied to an inner connection point of the foot plate.

13. The device of claim 11, wherein each movable, rotatable plate may be locked into place along a rail feature.

* * * * *

UNITED STATES PATENT AND TRADEMARK OFFICE

CERTIFICATE OF CORRECTION

PATENT NO. : 6,224,522 B1
DATED : May 1, 2001
INVENTOR(S) : Derrick Ervin

It is certified that error appears in the above-identified patent and that said Letters Patent is hereby corrected as shown below:

Title page,
ABSTRACT, line 6, replace "received" with -- receive --

Column 5,
Lines 17 and 19, replace "attache" with -- attach --

Column 6,
Line 27, after "features;" delete -- and --.
Line 34, after "sport;" insert -- and --
Line 45, replace "attached" with -- attaches --
Line 50, replace "two" with -- two --
Line 62, replace "form" with -- from --

Column 7,
Line 9, replace "connectionpoints of" with -- connection points on --
Line 9, replace "plate," with -- plate; --

Signed and Sealed this

Ninth Day of April, 2002

*Attest:*

*Attesting Officer*

JAMES E. ROGAN
*Director of the United States Patent and Trademark Office*